US005394028A

United States Patent [19]

Feddeler et al.

[11] Patent Number: 5,394,028

[45] Date of Patent: Feb. 28, 1995

[54] APPARATUS FOR TRANSITIONING BETWEEN POWER SUPPLY LEVELS

[75] Inventors: James R. Feddeler; Kenneth R. Burch, both of Austin, Tex.

[73] Assignee: Motorola, Inc., Schaumburg, Ill.

[21] Appl. No.: 904,430

[22] Filed: Jun. 26, 1992

[51] Int. Cl.[6] ..... G05F 3/16

[52] U.S. Cl. ..... 327/544; 327/546; 327/170

[58] Field of Search ..... 307/520, 542, 543, 550, 307/560, 263, 296.5, 296.8, 296.3, 272.3

[56] References Cited

U.S. PATENT DOCUMENTS

| | | | |
|---|---|---|---|
| 4,833,341 | 5/1989 | Watanabe et al. | 307/296.1 |
| 4,849,663 | 7/1989 | Kunze et al. | 307/521 |
| 4,947,063 | 8/1990 | O'Shaughnessy et al. | 307/542 |
| 5,027,002 | 6/1991 | Thorton | 307/296.8 |
| 5,187,396 | 2/1993 | Armstrong, II et al. | 307/296.8 |
| 5,218,239 | 6/1993 | Boomer | 307/542 |
| 5,241,226 | 8/1993 | Rossi et al. | 307/542 |

*Primary Examiner*—Timothy P. Callahan
*Assistant Examiner*—T. T. Lam
*Attorney, Agent, or Firm*—Susan C. Hill

[57] ABSTRACT

A method and apparatus for transitioning between power supply levels. In one form, the present invention uses a circuit (22) in a data processing system (10) to smoothly and gradually transition a Power Output signal from a first power supply level to a second power supply level during operation. This transition from a first power supply level to a second power supply level must be smooth and gradual so that a circuit, such as oscillator circuit (12), which is receiving its power from Power Output, may continue to function properly during the transition. A Control signal, which can change back and forth between a first logic level and a second logic level, is used to select which power supply level will be provided as the Power Output.

19 Claims, 3 Drawing Sheets

APPARATUS FOR TRANSITIONING BETWEEN POWER SUPPLY LEVELS

FIELD OF THE INVENTION

The present invention relates in general to transitioning between power supply levels, and more particularly to transitioning between power supply levels in a data processing system.

BACKGROUND OF THE INVENTION

Some integrated circuits require the ability to change power supply levels during operation. For example, some microcomputer integrated circuits need to be able to switch between a higher power supply and a lower power supply while the oscillator and clocking circuitry are generating clock signals. For some microcomputers, the lower power supply may be required to sufficiently reduce the power consumption of the integrated circuit in order to meet design requirements. Unfortunately, however, some circuitry on the microcomputer, such as oscillator circuits, are usually rendered more susceptible to noise when a lower power supply is used.

As a result, some microcomputers require the ability to switch between a higher power supply and a lower power supply during operation in order to adjust the tradeoff between power consumption and noise immunity. For example, some microcomputers use a higher power supply during the initial start up after power on, but then switch to a lower power supply during routine operation. As a result, the oscillator is less susceptible to noise when it is initially stabilizing, yet the microcomputer consumes less power during routine operation.

In addition to improved noise immunity, there are other possible advantages to using a higher power supply during start up. For example, some circuits require more power to operate properly during start up. These circuits may not function properly if a low power supply is used during start up; but these same circuits may work just fine using a low power supply once the start up process has been completed. Also, some circuits are able to complete the start up process more quickly when a higher power supply is used to power the circuits.

Unfortunately, however, some circuits cannot handle an abrupt change in power supply levels during operation. That is, an abrupt change in power supply levels during operation may cause some circuits to cease operating or to produce unpredictable outputs. For example, some oscillator circuits, low power amplifiers, bias generators, and comparators may not function properly if the power supply is abruptly changed.

SUMMARY OF THE INVENTION

The previously mentioned needs are fulfilled and other advantages achieved with the present invention. In one form, the present invention is an apparatus for transitioning between power supply levels.

In one embodiment, the apparatus is a circuit which has a first input power supply level, a second input power supply level, and an output power supply level. The circuit also has a control signal which is capable of changing back and forth between a first logic level and a second logic level. The circuit has a control means for receiving the control signal and for determining, based upon the control signal, which one of the first and second input power supply levels to provide as the output power supply level. In addition, the circuit has circuitry which is coupled to the first input power supply level, the second input power supply level, the output power supply level, and the control means. This circuitry is used for smoothly and gradually transitioning from providing the first input power supply level as the output power supply level to providing the second input power supply level as the output power supply level.

The present invention will be understood by one skilled in the art from the detailed description below in conjunction with the accompanying drawings.

DESCRIPTION OF THE PREFERRED EMBODIMENTS

Because some circuits cannot handle an abrupt transition in power supply levels during operation, a way was needed to allow a smooth and gradual transition from a first power supply to a second power supply during operation. The Power Output signal illustrated in FIGS. 1 and 2 meets this need. Power Output transitions smoothly and gradually between voltage and current levels of a first power supply and voltage and current levels of a second power supply. The fact that the transition from one power supply to another is gradual and smooth allows the circuitry receiving power from Power Output to continue to function properly during the transition.

Note that power may be calculated by multiplying voltage by current (i.e. Power=Voltage×Current). In the preferred embodiments of the present invention, High Power supplies more power than Low Power for a given current value because High Power is at a higher voltage potential than Low Power. However, in alternate embodiments of the present invention, High Power may supply more power for a predetermined voltage level due to the fact that High Power supplies more current than Low Power.

Figure 1:
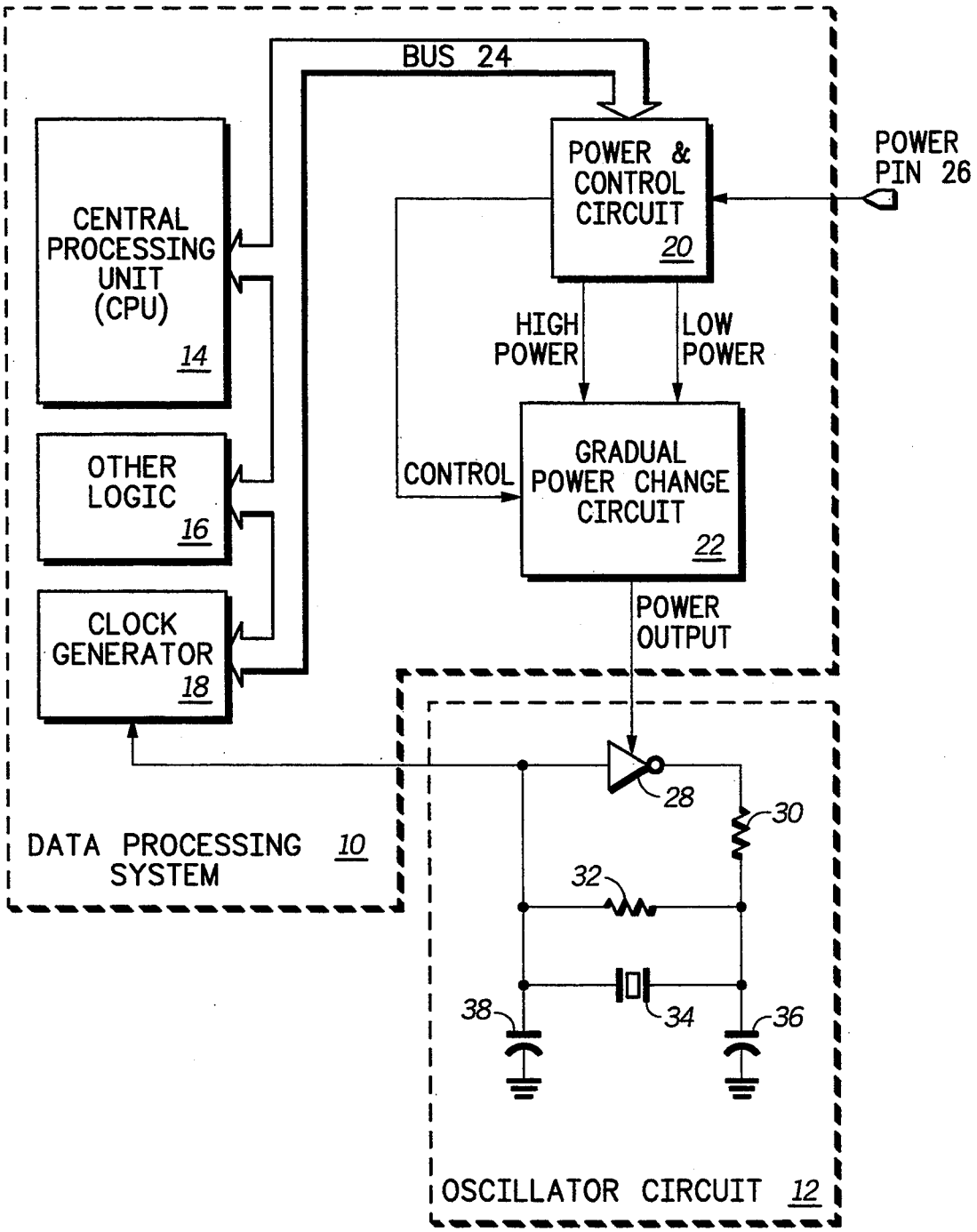
FIG. 1 illustrates, in partial block diagram form, in partial logic diagram form, and in partial schematic diagram form, a data processing system 10 and an oscillator circuit 12 in accordance with one embodiment of the present invention.
Figure 2:
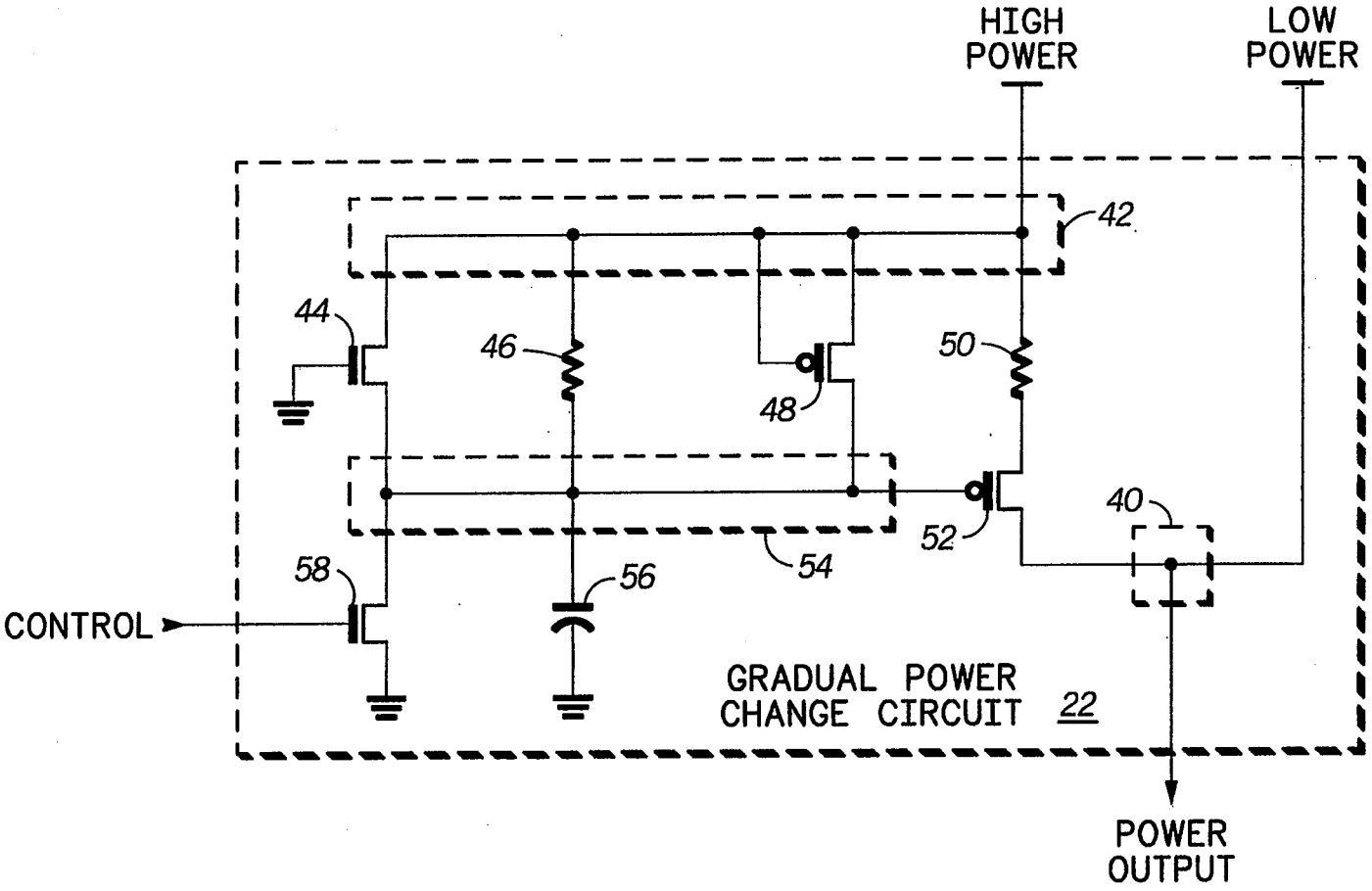
FIG. 2 illustrates, in schematic diagram form, a gradual power change circuit 22 of FIG. 1 in accordance with one embodiment of the present invention.

The only required relationship between "power" and "ground" as illustrated in FIGS. 1 and 2 is that the potential of power must be more positive than the potential of ground. In the preferred embodiment, a logic level zero represents approximately the potential of ground and a logic level one represents approximately the potential of the positive power supply being applied to the circuit. Other embodiments may use a negative power supply or may use a different definition of the logic levels. Note that if a negative power supply is used, the nodes illustrated in FIGS. 1 and 2 as being coupled or connected to ground must be coupled or connected to the more negative potential.

DESCRIPTION OF THE FIGURES

FIG. 1 illustrates a data processing system 10 and an oscillator circuit 12. Data processing system 10 has a central processing unit (CPU) 14, other logic circuitry 16, clock generator circuit 18, power and control circuit 20, and gradual power change circuit 22. CPU 14, other logic 16, clock generator 18, and power and control circuit 20 are all bi-directionally coupled to bus 24. Power and control circuit 20 receives power from power pin 26. Power and control circuit 20 provides a High Power supply, a Low Power supply, and a Control signal to gradual power change circuit 22. Gradual power change circuit 22 provides a Power Output signal to oscillator circuit 12.

Oscillator circuit 12 has an amplifier 28 which receives power from the Power Output signal provided by gradual power change circuit 22. The output of amplifier 28 is connected to a first terminal of resistor 30. A second terminal of resistor 30 is connected to a first terminal of resistor 32, a first terminal of crystal 34, and a first electrode of tuning capacitor 36. The input of amplifier 28 is connected to a second terminal of resistor 32, a second terminal of crystal 34, and a first terminal of input capacitor 38. Both the second terminal of tuning capacitor 36 and the second terminal of input capacitor 38 are connected to ground. The input of amplifier 28 is coupled to clock generator 18 in order for clock generator 18 to receive an oscillating signal.

FIG. 2 illustrates a gradual power change circuit 22 of FIG. 1 in accordance with one embodiment of the present invention. The gradual power change circuit 22 in FIG. 2 provides a smooth and gradual transition from High Power to Low Power, but an abrupt transition from Low Power back to High Power. Gradual power change circuit 22 is useful for applications where the only smooth and gradual transition that must be made during operation is a transition from High Power to Low Power.

As an illustrative use of gradual power change circuit 22, some microcomputers use a higher power supply to power an oscillator during the initial start up after power on to improve noise immunity, but then switch to a lower power supply during routine operation in order to reduce power consumption. If the Low Power to High Power transition is not used, or if the Low Power to High Power transition is only used when a system error has occurred, then it is not necessary for the Low Power to High Power transition to be smooth.

Still referring to FIG. 2, a Low Power supply labeled "Low Power" is applied at node 40. A High Power supply labeled "High Power" is applied at node 42. The only necessary relationship between High Power and Low Power is that High Power must supply more power than Low Power.

Also coupled to node 42 is a first current electrode of transistor 44, a first terminal of resistor 46, a first current electrode and a control electrode of transistor 48, and a first terminal of resistor 50. A control electrode of transistor 44 is coupled to ground. A second terminal of resistor 50 is coupled to a first current electrode of transistor 52. The second current electrode of transistor 52 is coupled to node 40. A control electrode of transistor 52 is coupled to a node 54.

Also coupled to node 54 is a second current electrode of transistor 44, a second terminal of resistor 46, a second current electrode of transistor 48, a first electrode of capacitor 56, and a first current electrode of transistor 58. A second current electrode of transistor 58 and a second electrode of capacitor 56 are both coupled to ground. A Control signal labeled "Control" is applied to a control electrode of transistor 58. An output signal labeled "Power Output" is provided from node 40.

In one embodiment of the gradual power change circuit 22 of FIG. 2, transistors 44 and 58 were implemented using n-channel enhancement mode field effect transistors; and transistors 48 and 52 were implemented using p-channel enhancement mode field effect transistors. Also in this embodiment, resistor 46 was approximately 40 gigaohms, resistor 50 was approximately 10 kilohms, and capacitor 56 was approximately 10 picofarads.

Figure 3:
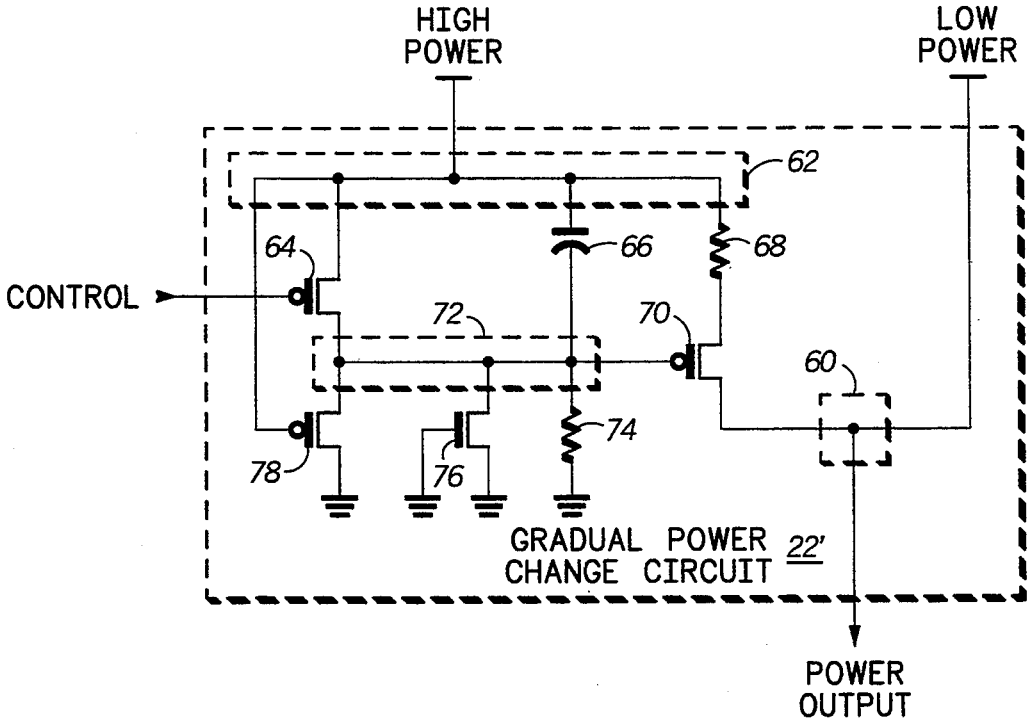
FIG. 3 illustrates, in schematic diagram form, a gradual power change circuit 22' of FIG. 1 in accordance with one embodiment of the present invention.

FIG. 3 illustrates a gradual power change circuit 22' of FIG. 1 in accordance with one embodiment of the present invention. The gradual power change circuit 22' in FIG. 3 provides a smooth and gradual transition from Low Power to High Power, but an abrupt transition from High Power back to Low Power. Gradual power change circuit 22 is useful for applications where the only smooth and gradual transition that must be made during operation is a transition from Low Power to High Power.

Still referring to FIG. 3, a Low Power supply labeled "Low Power" is applied at node 60. A High Power supply labeled "High Power" is applied at node 62. The only necessary relationship between High Power and Low Power is that High Power must supply more power than Low Power.

Also coupled to node 62 is a first current electrode of transistor 64, a first electrode of capacitor 66, and a first terminal of resistor 68. A second terminal of resistor 68 is coupled to a first current electrode of transistor 70. The second current electrode of transistor 70 is coupled to node 60. A control electrode of transistor 70 is coupled to a node 72.

Also coupled to node 72 is a second electrode of capacitor 66, a second current electrode of transistor 64, a first terminal of resistor 74, a first current electrode of transistor 76, and a first current electrode of transistor 78. A second terminal of resistor 74, a second current electrode of transistor 76, a control electrode of transistor 76, and a second current electrode of transistor 78 are all coupled to ground. A control electrode of transistor 78 is coupled to node 62. A Control signal labeled "Control" is applied to a control electrode of transistor 64. An output signal labeled "Power Output" is provided from node 60.

In one embodiment of gradual power change circuit 22' of FIG. 3, transistor 76 could be implemented using an n-channel enhancement mode field effect transistor; and transistors 64, 70, and 78 could be implemented using p-channel enhancement mode field effect transistors. Also in this embodiment, resistor 74 could be approximately 40 gigaohms, resistor 68 could be approximately 10 kilohms, and capacitor 66 could be approximately 10 picofarads.

Figure 4:
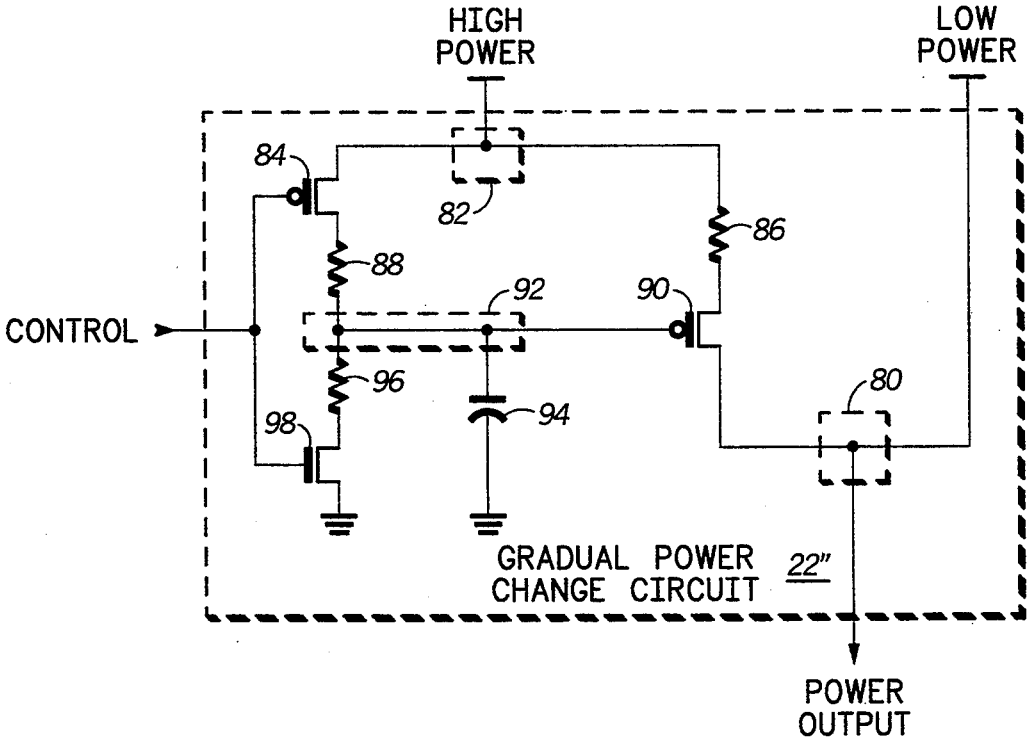
FIG. 4 illustrates, in schematic diagram form, a gradual power change circuit 22" of FIG. 1 in accordance with one embodiment of the present invention.

FIG. 4 illustrates a gradual power change circuit 22" of FIG. 1 in accordance with one embodiment of the present invention. The gradual power change circuit 22" in FIG. 4 provides a smooth and gradual transition from Low Power to High Power, and a smooth and gradual transition from High Power to Low Power. Gradual power change circuit 22" is useful for applications where a smooth and gradual transition must be made during operation both from High Power to Low Power and from Low Power to High Power.

Still referring to FIG. 4, a Low Power supply labeled "Low Power" is applied at node 80.. A High Power supply labeled "High Power" is applied at node 82. The only necessary relationship between High Power and Low Power is that High Power must supply more power than Low Power.

Also coupled to node 82 is a first current electrode of transistor 84 and a first terminal of resistor 86. A second current electrode of transistor 84 is coupled to a first terminal of resistor 88. A second terminal of resistor 86 is coupled to a first current electrode of transistor 90. The second current electrode of transistor 90 is coupled to node 80. A control electrode of transistor 90 is coupled to a node 92.

Also coupled to node 92 is a second terminal of resistor 88, a first electrode of capacitor 94, and a first terminal of resistor 96. A second terminal of resistor 96 is coupled to a first current electrode of transistor 98. A second current electrode of transistor 98 and a second electrode of capacitor 94 are coupled to ground. A Control signal labeled "Control" is applied to a control electrode of transistor 84 and is applied to a control electrode of transistor 98. An output signal labeled "Power Output" is provided from node 80.

In one embodiment of gradual power change circuit 22" of FIG. 4, transistor 98 could be implemented using an n-channel enhancement mode field effect transistor; and transistors 84 and 90 could be implemented using p-channel enhancement mode field effect transistors. Also in this embodiment, resistors 88 and 96 could each be approximately 40 gigaohms, resistor 86 could be approximately 10 kilohms, and capacitor 94 could be approximately 10 picofarads.

OPERATION OF THE PREFERRED EMBODIMENTS

The operation of the data processing system 10 and the oscillator circuit 12 of FIG. 1 will now be described. Data processing system 10 operates in the same manner as prior art devices except for the power and control circuit 20, the gradual power change circuit 22, and the Power Output signal. The physical circuitry of oscillator circuit 12 is known in the prior art, but the circuitry of oscillator circuit 12 has improved performance when the power it receives from the Power Output signal is varied.

Note that for one embodiment of the present invention illustrated in FIG. 1, amplifier 28, resistor 32, and capacitor 38 are all located on the same integrated circuit as data processing system 10. Also in this same embodiment, resistor 30 is not actually built, but is a resistance due merely to parasitic resistances. In addition, amplifier 28 is an inverting amplifier in this same embodiment, although other embodiments of oscillator circuit 12 could use a non-inverting amplifier instead.

Power and control circuit 20 receives power from power pin 26, and then uses this power to output a High Power supply and a Low Power supply to gradual power change circuit 22. Again, note that the only necessary relationship between High Power and Low Power is that High Power must supply more power than Low Power. Any technique could be used by power and control circuit 20 in order to create a voltage differential between High Power and Low Power. For example, in one embodiment of the present invention two resistors with different resistance values are used to create a voltage differential. Other embodiments of the present invention could use various active or passive electronic devices to create this voltage differential. In addition, other embodiments could use a current differential rather than a voltage differential to generate High Power and Low Power.

In the preferred embodiment, the Low Power supply is not available during start up. This is because the power and control circuit 20 in the preferred embodiment uses a capacitive voltage divider (not shown) which utilizes active devices (not shown) to generate Low Power. These active devices (not shown) require at least one clock signal from clock generator 18 in order to generate the Low Power supply. But during start up, clock generator 18 does not output clock signals onto bus 24 until the oscillator circuit 12 has sufficiently stabilized. Thus during the start up process, when power and control circuit 20 has not yet begun to receive clock signals, the capacitive voltage divider (not shown) is not functioning and Low Power supply is not available.

Therefore, in the preferred embodiment, the voltage on Low Power is permitted to be approximately the same as the voltage on High Power during start up. However, once power and control circuit 20 begins to receive clock signals from clock generator 18, power and control circuit 20 then lowers the voltage of Low Power to the desired potential. Therefore in the preferred embodiment, the Control signal will always select High Power during start up. Thus, the gradual power change circuit 22 will always output High Power as the Power Output during start up.

Alternate embodiments which require Low Power at start up may use passive devices which do not require a clock signal in order to generate Low Power during start up. Additionally, other embodiments may use two power pins 26 where one power pin supplies a higher voltage than the other.

The purpose of the gradual power change circuit 22 is to provide a Power Output signal that smoothly and gradually transitions, during operation, from the voltage and current levels of a first power supply to the voltage and current levels of a second power supply. This smooth and gradual transition may be required by some circuits. For example, the oscillator circuit 12 illustrated in FIG. 1 may not function properly if the Power Output signal transitions abruptly from the voltage and current levels of the High Power supply to the voltage and current levels of the Low Power supply.

In the embodiment of the present invention illustrated in FIG. 1, Power Output is used to power amplifier 28 in oscillator circuit 12. With the exception of Power Output, oscillator circuit 12 functions in the same manner as a standard oscillator. Oscillator circuit 12 provides an oscillating signal to clock generator 18. Clock generator 18 then uses this oscillating signal to generate clock signals for data processing system 10. Although the input of amplifier 28 was coupled to clock generator 18 in the illustrated embodiment, the output of amplifier 28 could instead be coupled to clock generator 18 in an alternate embodiment. In fact, in alternate embodiments of the present invention, other types of oscillator circuits that used Power Output to power an amplifier could be used.

The Control signal received by gradual power change circuit 22 is used to determine which power supply, High Power or Low Power, is coupled by gradual power change circuit 22 to Power Output. When Control signal is at a first logic level, High Power is coupled to Output Power; and when Control signal is at a second logic level, Low Power is coupled to Output Power. Control signal can change back and forth as many times as desired between the first logic level and the second logic level. Thus by way of the Control signal, the power supplied at Power Output can be changed from a first power supply to a second power supply and back again as many times as desired. Although the Control signal is illustrated as being provided by power and control circuit 20, the Control signal could have been generated anywhere in data processing system 10, or even external to data processing system 10.

Aside from start up, there are also other situations in which it may be useful to transition from a first power supply to a second power supply. As a first example, if certain internal states are detected in data processing system 10, such as an illegal address, an illegal opcode, or reset, it may be useful to transition to using High Power during the period of time that data processing system 10 is trying to recover.

As a second example, it may be useful to transition to using High Power during periods of time that data processing system 10 is subject to high levels of electrical noise, such as when there is significant activity (i.e. toggling) on the external integrated circuit pins (not shown), or when a significant amount of noise is generated internal to data processing system 10.

As a third example, it may be necessary to transition to using High Power during periods of time when the power supplied by power pin 26 has been reduced to a level where the Low Power generated by power and control circuit 20 is too low. If Low Power is being used and is too low, then Low Power will not be sufficient to power the circuitry coupled to Power Output. Thus if Low Power is too low, the Control signal must couple High Power to Power Output in order for the circuitry coupled to Power Output to function properly.

As a fourth example, a user programmable control bit could optionally be provided so that the user of data processing system 10 could select, under software control, whether High Power or Low Power was coupled to Power Output. This control bit may reside in CPU 14, power and control circuit 20, or any other portion of data processing system 10. If a control bit is used, the user of data processing system 10 has software control of which power supply level, High Power or Low Power, to provide at Power Output.

Aside from the above four examples, a transition between High Power and Low Power can be made at any time that is desirable, either under hardware or software control. The use of the Control signal allows complete flexibility to determine when to transition from High Power to Low Power and when to transition from Low Power to High Power.

As the above examples illustrate, one factor or many factors may be used to determine the logic level of the Control signal in any particular embodiment. In some embodiments, the power and control circuit 20 independently determines what logic level to make the Control signal. However, in other embodiments, power and control circuit 20 receives inputs from one or more portions of data processing system 10, evaluates these inputs, and then selects the proper logic level for the Control signal based upon whether High Power or Low Power is desired.

The Control signal is an important feature of the present invention. The Control signal allows the designer and/or user of data processing system 10 complete flexibility to determine when to transition from High Power to Low Power and when to transition from Low Power to High Power. The Control signal thus allows complete flexibility to control the power supplied to various circuitry, such as oscillator circuit 12, depending upon the requirements of the particular application and the internal state of data processing system 10.

The requirements of the circuit which uses the Power Output as its source of power help determine which embodiment of the present invention to use. FIG. 2 illustrates one embodiment of the gradual power change circuit 22 of FIG. 1. This particular embodiment of the gradual power change circuit 22 provides a smooth and gradual transition from High Power to Low Power, but an abrupt transition from Low Power to High Power. Other embodiments of the present invention, such as circuit 22' in FIG. 3, could be used to provide a smooth and gradual transition from Low Power to High Power, but an abrupt transition from High Power to Low Power. In addition, other embodiments of the present invention, such as circuit 22" in FIG. 4, could be used to provide a smooth and gradual transition both from High Power to Low Power, and from Low Power to High Power.

Note that some data processing systems 10 only make one transition from a first power supply level to a second power supply level during operation; and consequently only the transition from the first power supply level to the second power supply level must be smooth and gradual. Alternately, different data processing systems 10 may make multiple transitions between the available power supply levels. But the circuits receiving power from these different data processing systems 10 may only require a smooth and gradual transition from the first power supply level to the second power supply level in order to function properly. The circuits receiving power from these different data processing systems 10 may continue to function properly even if their power supply transition from the second power supply level to the first power supply level is abrupt.

In the preferred embodiment of data processing system 10 and oscillator circuit 12, the Power Output signal in FIG. 1 transitions slowly and smoothly from the voltage and current levels of the High Power supply to the voltage and current levels of the Low Power supply. However, the transition from Low Power back to High Power is abrupt. The smooth transition from High Power to Low Power ensures that oscillator circuit 12 continues to function properly during the transition.

The operation of the gradual power change circuit 22 illustrated in FIG. 2 will now be described. High Power is continuously applied to node 42 while Low Power is continuously applied to node 40. In the preferred embodiment, a voltage of approximately three volts is supplied at power pin 26. Thus, in the preferred embodiment, High Power is roughly three volts and Low Power is generally in the range of 0.7 volts to 1.5 volts. Other voltages could have been used, as long as the voltage of High Power was a higher voltage potential than the voltage of Low Power.

A transition from High Power to Low Power will be discussed first. Before the transition begins, Power Output is at approximately the same voltage level as High Power. The Control signal is at a logic level one. Because the Control signal is a logic level one, transistor 58 is conductive and therefore node 54 is at approximately the same potential as ground. Thus the first and second electrodes of capacitor 56 are both at approximately the same potential, and consequently capacitor 56 is not storing any charge. Because the control electrode of n-channel transistor 44 is coupled to ground, transistor 44 is always non-conductive. Because the control electrode of p-channel transistor 48 is coupled to High Power, transistor 48 is always non-conductive. The purpose of transistors 44 and 48 will be discussed hereinafter.

P-channel transistor 52 is conductive because its control electrode is at approximately the same potential as ground. Because p-channel transistor 52 is conductive, current can flow from node 42 to node 40. Thus the voltage on node 40 is approximately the same as the voltage on node 42. Note that the voltage drop across resistor 50 is minimal. The purpose of resistor 50 will be discussed hereinafter. The power supplied by Power Output is thus approximately the same as the power supplied by High Power.

The Control signal is used by gradual power change circuit 22 to determine whether High Power or Low Power will be provided as the power supply level at Power Output. The Control signal is capable of changing back and forth between a first logic level and a second logic level. A change in logic level of the Control signal initiates a transition from one power supply level to the other.

In the preferred embodiment, the Control signal is changed from a logic level one to a logic level zero in order to initiate the transition from High Power to Low Power. The Control signal is then a logic level zero. Because the Control signal is a logic level zero, transistor 58 is non-conductive and therefore capacitor 56 begins to store charge using the current path from High Power through resistor 46. Eventually node 54 will be at approximately the same potential as High Power.

As the potential on node 54 rises gradually from approximately the potential of ground to approximately the potential of High Power, p-channel transistor 52 gradually becomes non-conductive. Once p-channel transistor 52 is non-conductive, current can no longer flow from node 42 to node 40. As a result, the voltage on node 40 is approximately the same as the voltage of Low Power; and the power supplied by Power Output is approximately the same as the power supplied by Low Power. Thus Low Power is now supplying the power to Power Output.

The RC time constant due to resistor 46 and capacitor 56 determines approximately how long it takes to transition from High Power to Low Power as the source of power at Power Output. This is because the RC time constant due to resistor 46 and capacitor 56 causes the potential on node 54 to rise gradually from the potential of ground to approximately the potential of High Power. The larger the RC time constant, the slower the transition from High Power to Low Power as the source of power at Power Output.

The purpose of transistor 44 will now be discussed. In the preferred embodiment of gradual power change circuit 22 illustrated in FIG. 2, resistor 46 is very large, on the order of tens of gigaohms, and is fabricated using undoped polysilicon. A large resistor 46 is used in order to increase the RC time constant. The channel resistance of transistor 58 is on the order of hundreds or thousands of gigaohms when transistor 58 is non-conducting. As long as the channel resistance of transistor 58 is at least an order of magnitude greater than the resistance value of resistor 46, the potential of node 54 can rise to approximately the potential of High Power when transistor 58 is conducting.

Unfortunately, however, a problem arises if the resistance of resistor 46 is too large. The resistance of undoped polysilicon may vary by several orders of magnitude within normal operating temperatures. In addition, the resistance of undoped polysilicon may vary due to deviations in the process of fabricating integrated circuits. If the resistance of resistor 46 is on the same order of magnitude as the channel resistance of transistor 58, then node 54 may never rise to approximately the potential of High Power and transistor 52 would continue to conduct current from High Power to Power Output.

Transistor 44 provides a channel resistance comparable in magnitude to the channel resistance of transistor 58. Placing the large channel resistance of transistor 44 in parallel with resistor 46 helps ensure that the potential of node 54 can rise to approximately the potential of High Power when transistor 58 is conducting. Thus transistor 44 allows circuit 22 to operate over a wider range of values of resistor 46.

The purpose of transistor 48 will now be discussed. The purpose of transistor 48 is to balance the junction leakage currents from drain to substrate of transistors 44 and 58. In the preferred embodiment of gradual power change circuit 22 illustrated in FIG. 2, both transistors 44 and 58 have a junction leakage current from drain to substrate. The resistance from drain to substrate for transistors 44 and 58 may be hundreds or thousands of gigaohms. If the resistance of resistor 46 is on the same order of magnitude as the resistance from drain to substrate for transistors 44 and 58, then the junction leakage current from drain to substrate of transistor 44 and 58 may be significant.

Both transistors 44 and 58 are built in bulk semiconductor material which is electrically connected to ground. Transistor 48, on the other hand, is built in bulk semiconductor material which is electrically connected to the same potential as High Power. As a result, the junction leakage current from drain to substrate (i.e. from node 54 to High Power) of transistor 48 compensates for the junction leakage currents from drain to substrate (i.e. from node 54 to ground) of transistors 44 and 58.

The purpose of resistor 50 will now be discussed. The purpose of resistor 50 is to make the conducting to non-conducting transition of transistor 52 more gradual and less abrupt. If the drain current of transistor 52 ($I_D$) is plotted on the vertical axis of a graph, and the voltage difference between nodes 42 and 54 ($V_{GS}$) is plotted on the horizontal axis, resistor 50 has the effect of causing a flattening of the $I_D$ vs. $V_{GS}$ curve toward the horizontal axis. Thus resistor 50 causes the change in the slope of the $I_D$ vs. $V_{GS}$ curve to be more gradual. The end result is that the Power Output signal transitions more gradually from the voltage and current levels of High Power to the voltage and current levels of Low Power.

Gradual power change circuit 22 thus uses Control signal to select between High Power and Low Power as the power supply for Output Power. The transition from High Power to Low Power is smooth, gradual, and not abrupt. The transition from Low Power to High Power is abrupt.

Referring to FIG. 3, the gradual power change circuit 22' provides a smooth, gradual transition from Low Power to High Power, but the transition from High Power to Low Power is abrupt. The functionality of gradual power change circuit 22' is based on the same principles as the functionality of gradual power change circuit 22. Node 60 corresponds to node 40; node 62 corresponds to node 42; and node 72 corresponds to node 54. Transistor 64 corresponds to transistor 58; transistor 78 corresponds to transistor 44; transistor 76 corresponds to transistor 48; and transistor 70 corresponds to transistor 52. Capacitor 66 corresponds to capacitor 56; resistor 74 corresponds to resistor 46; and resistor 68 corresponds to resistor 50.

Referring to FIG. 4, the gradual power change circuit 22'' provides a smooth, gradual transition from Low Power to High Power and from High Power to Low Power. The functionality of gradual power change circuit 22'' is based on the same principles as the functionality of gradual power change circuit 22. Transistors 84 and 98 correspond to transistor 58. Resistors 88 and 96 correspond to resistor 46. Capacitor 94 corresponds to capacitor 56. Resistor 86 corresponds to resistor 50. Transistor 90 corresponds to transistor 52. There is no need for compensating transistors 44 and 48 because the leakage current of transistor 84 is in series with resistor 88 and the leakage current of transistor 98 is in series with resistor 96. As a result, the leakage currents have a reduced effect.

Summary and Some Alternate Embodiments

In summation, the above specification describes a method and apparatus for transitioning between power sources in a data processing system 10. The present invention allows a smooth and gradual transition from a first power supply to a second power supply during operation. The Power Output signal, which is illustrated in each figure, transitions smoothly and gradually between voltage and current levels of a first power supply and voltage and current levels of a second power supply. The fact that the transition from one power supply to another is gradual and smooth allows the circuitry receiving power from Power Output to continue to function properly during the transition.

While the present invention has been illustrated and described with reference to specific embodiments, further modifications and improvements will occur to those skilled in the art. For example, various modifications could be made to the gradual power change circuits 22, 22', and 22''. For instance, the values of resistive and capacitive elements could be modified. Also, in some instances passive elements could be used to replace active elements, and vice versa. For example, in alternate embodiments of the present invention, an active device such as a transistor could be used instead of a passive device such as a resistor or capacitor. Likewise a passive device could be used to replace an active device that was serving the function of a resistor or capacitor, such as transistor 44 in FIG. 2.

In FIG. 2, the value of resistor 46 determines whether or not a balancing resistance supplied by transistor 44 is needed. Even if resistor 46 is approximately the same as the non-conducting channel resistance of transistor 58, other techniques could be used to ensure that node 54 rises to a sufficient potential. Other techniques, aside from the addition of transistor 48, could be used to balance the junction leakage currents from drain to substrate of transistors 44 and 58. Circuit 22 would still function without resistor 50, but the transition between High Power and Low Power would not be as gradual.

The use of transistor 58 in FIG. 2 and transistors 84 and 98 in FIG. 4 allows the following alternate embodiment of the present invention. In this alternate embodiment of the present invention, High Power, instead of ground, is coupled to the second electrode of capacitor 56 in FIG. 2 and capacitor 94 in FIG. 4. If High Power, rather than ground, is coupled to the second electrode of capacitor 56, then resistor 46 is discharging, rather than charging, capacitor 56 during the transition from High Power to Low Power. Likewise, if High Power, rather than ground, is coupled to the second electrode of capacitor 94, then resistor 88 is discharging, rather than charging, capacitor 94 during the transition from High Power to Low Power.

In alternate embodiments of the present invention, Power Output could be used to supply power to any type of circuit, including circuits within data processing 10 and circuits outside of data processing system 10. Power Output would be especially useful in powering circuits, such as certain oscillator circuits, low power amplifiers, bias generators, and comparators, which may not function properly if the power supply is abruptly changed. In alternate embodiments of the present invention, the circuit receiving power from Power Output may not be located, may be partially located, or may be entirely located on the same integrated circuit as data processing system 10.

In alternate embodiments of the present invention, more than two input power supply levels may be used. For example, the use of three input power supply levels, namely high, medium, and low, can be separated into three circuits, each circuit having a High Power input and a Low Power input. As an illustration, the high power supply level could be coupled to the High Power input of the first circuit. The medium power supply level could be coupled to the High Power input of the second circuit. And, the low power supply level could be coupled to the Low Power input of both the first and second circuits. The Power Output of the first circuit could then be coupled to the High Power input of the third circuit; and the Power Output of the second circuit could then be coupled to the Low Power input of the third circuit. This same principle extends and applies to more than three input power supply levels.

In the illustrated embodiments of the present invention, only oscillator circuit 12 receives power by way of the Power Output signal. In alternate embodiments of the present invention, however, Power Output could be used to supply power to one or more selected portions of data processing system 10, or to all of data processing system 10.

Note that in the illustrated embodiments of the present invention, High Power is able to overdrive Low Power without any detrimental effects to data processing system 10. If data processing system 10 was designed in such a way that allowing High Power to overdrive Low Power would detrimentally effect data processing system 10, gradual power change circuits 22, 22' and 22'' could be modified in order to prevent any detriment overdrive of Low Power by High Power. Such a modification would be obvious to one of average skill in the art.

It is to be understood, therefore, that this invention is not limited to the particular forms illustrated and that it is intended in the appended claims to cover all modifications that do not depart from the spirit and scope of this invention.

We claim:

1. A circuit for transitioning between power supply levels, comprising:

a first input power supply terminal for receiving a first power supply level;

a second input power supply terminal for receiving a second power supply level;

a third input power supply terminal for receiving a third power supply level;

an output power supply terminal for providing primary power to operate a target circuit;

a control signal;

a control means for receiving said control signal and for determining, based upon said control signal, which one of said first and second input power supply levels to provide at said output power supply terminal; and a circuit means for smoothly and gradually transitioning from providing said first input power supply level to providing said second input power supply level at said output power supply terminal, said circuit means transitioning in response to said control means, said circuit means being coupled to said first input power supply terminal, said second input power supply terminal, said third input power supply terminal, said output power supply terminal, and said control means.

2. A circuit as in claim 1, wherein said circuit means is capable of transitioning from providing said second input power supply level at said output power supply terminal, to subsequently providing said first input power supply level at said output power supply terminal.

3. A circuit as in claim 1, wherein said circuit means comprises:

a resistive element coupled between said first input power supply terminal and said output power supply terminal.

4. A circuit as in claim 1, wherein said control means comprises:

a field effect transistor, having a first current electrode coupled to said circuit means, having a second current electrode coupled to said third input power supply terminal, and having a control electrode coupled to receive said control signal.

5. A circuit as in claim 1, wherein said target circuit comprises:

an amplifier having an amplifier input, an amplifier output, and a power input, the power input being coupled to said output power supply terminal, said amplifier receiving primary power from said output power supply terminal.

6. A circuit as in claim 1, wherein said circuit means comprises:

a first p-channel field effect transistor, having a first current electrode coupled to said first input power supply terminal, having a second current electrode coupled to said output power supply terminal, and having a control electrode coupled to said control means.

7. A circuit as in claim 6, wherein said circuit means further comprises:

a first resistive element coupled between said first input power supply terminal and the first current electrode of said first p-channel field effect transistor.

8. A circuit as in claim 7, wherein said control means comprises:

an n-channel field effect transistor (98), having a first current electrode, having a second current electrode coupled to said third input power supply terminal, and having a control electrode coupled to said control signal; and a second p-channel field effect transistor (84), having a first current electrode coupled to said first input power supply terminal having a second current electrode, and having a control electrode coupled to said control signal a second resistive element having a first terminal coupled to said second current electrode of said second P-channel field effect transistor, and having a second terminal coupled to the control electrode of said first P-channel field effect transistor;

a third resistive element, having a first terminal coupled to the control electrode of said first P-channel field effect transistor, and having a second terminal coupled to said first current electrode of said n-channel field effect transistor; and a capacitive element, having a first electrode coupled to the control electrode of said first P-channel field effect transistor, and having a second electrode coupled to said third input power supply terminal.

9. A circuit as in claim 7, wherein said circuit means further comprises:

a second resistive element, having a first terminal coupled to the control electrode of said first p-channel field effect transistor, and having a second terminal coupled to a one of said first input power supply terminal and said third input power supply terminal;

a third resistive element, coupled in parallel with said second resistive element, said third resistive element having a first terminal coupled to the control electrode of said first p-channel field effect transistor, and having a second terminal coupled to the one of said first input power supply terminal and said third input power supply terminal; and a capacitive element, having a first electrode coupled to the control electrode of said first p-channel field effect transistor, and having a second electrode coupled to an other of the one of said first input power supply terminal and said third input power supply terminal.

10. A circuit as in claim 9, wherein said control means comprises:

an n-channel field effect transistor (58), having a first current electrode coupled to the control electrode of said first p-channel field effect transistor, having a second current electrode coupled to said third input power supply terminal, and having a control electrode coupled to said control signal.

11. A circuit as in claim 10, wherein said circuit means further comprises:

a second p-channel field effect transistor (48), having a first current electrode coupled to said first input power supply terminal, having a second current electrode coupled to the control electrode of said first p-channel field effect transistor, and having a control electrode coupled to said first input power supply terminal.

12. A circuit as in claim 9, wherein said control means comprises:

a second p-channel field effect transistor (64), having a first current electrode coupled to the control electrode of said first p-channel field effect transistor, having a second current electrode coupled to said first input power supply terminal, and having a control electrode coupled to said control signal.

13. A circuit as in claim 12, wherein said circuit means further comprises:

an n-channel field effect transistor (76) having a first current electrode coupled to the control electrode of said first p-channel field effect transistor, having a second current electrode coupled to said third input power supply terminal, and having a control electrode coupled to said third input power supply terminal.

14. A data processing system, comprising:

a target circuit; and a circuit for transitioning between power supply levels; and wherein said circuit for transitioning between power supply levels comprises:

a first input power supply terminal for receiving a first power supply level;

a second input power supply terminal for receiving a second power supply level;

a third input power supply terminal for receiving a third power supply level;

an output power supply terminal for providing an output power supply level, said output power supply terminal providing primary power to operate said target circuit, said output power supply terminal being coupled to said target circuit;

a control signal which is capable of changing back and forth between a first logic level and a second logic level;

a control means for receiving said control signal and for determining, based upon said control signal, which one of said first and second input power supply levels to provide at said output power supply terminal; and a circuit means for smoothly and gradually transitioning from providing said first input power supply level to providing said second input power supply level at said output power supply terminal, said circuit means transitioning in response to said control means, said circuit means being coupled to said first input power supply terminal, said second input power supply terminal, said third input power supply terminal, said output power supply terminal, and said control means.

15. A data processing system as in claim 14, wherein said first power supply level is at a higher voltage potential than said second power supply level, and wherein said second power supply level is at a higher voltage potential than said third power supply level.

16. A data processing system as in claim 14, wherein said target circuit comprises:

an amplifier having an amplifier input, an amplifier output, and a power input, the power input being coupled to said output power supply terminal, said amplifier receiving primary power from said output power supply terminal.

17. A data processing system as in claim 14, wherein said circuit means comprises:

a resistive element, having a first terminal coupled to said first input power supply terminal, and having a second terminal; and a p-channel field effect transistor, having a first current electrode coupled to the second terminal of said resistive element, having a second current electrode coupled to said second input power supply terminal and coupled to said output power supply terminal and having a control electrode coupled to said control means.

18. A data processing system, comprising:

a target circuit; and a circuit for transitioning between power supply levels; and wherein said circuit for transitioning between power supply levels comprises:

a first input power supply terminal for receiving a first power supply level;

a second input power supply terminal for receiving a second power supply level;

a third input power supply terminal for receiving a third power supply level;

an output power supply terminal for providing an output power supply level, said output power supply terminal providing primary power to operate said target circuit, said output power supply terminal being coupled to said target circuit;

a control signal;

a control means for receiving said control signal and for determining, based upon said control signal, which one of said first and second input power supply levels to provide at said output power supply terminal; and a circuit means for smoothly and gradually transitioning from providing said first input power supply level to providing said second input power supply level at said output power supply terminal, said circuit means being capable of subsequently transitioning back to providing said first input power supply level at said output power supply terminal, said circuit means transitioning in response to said control means, said circuit means being coupled to said first input power supply terminal, said second input power supply terminal, said third input power supply terminal, said output power supply terminal, and said control means.

19. A circuit as in claim 18, wherein said circuit means further comprises:

a first resistive element, having a first terminal coupled to said first input power supply terminal, and having a second terminal;

a field effect transistor, having a first current electrode coupled to the second terminal of said first resistive element, having a second current electrode coupled to said output power supply terminal, and having a control electrode;

a second resistive element having a first terminal coupled to the control electrode of said field effect transistor, and having a second terminal coupled to a one of said first input power supply terminal and said third input power supply terminal; and a capacitive element, having a first electrode coupled to the control electrode of said field effect transistor, and having a second electrode coupled to an other of the one of said first input power supply terminal and said third input power supply terminal.

* * * * *